United States Patent [19]

Mizutani et al.

[11] 4,188,135

[45] Feb. 12, 1980

[54] MULTIPLE INKED RIBBON COLOR CHANGEOVER MECHANISM FOR PRINTING MACHINE

[75] Inventors: Nagao Mizutani, Hachioji; Takashi Sawada; Yasuo Okawara, both of Sayama; Michio Koizumi; Toshio Kurihara, both of Tokorozawa, all of Japan

[73] Assignee: Citizen Watch Co., Ltd., Tokyo, Japan

[21] Appl. No.: 827,054

[22] Filed: Aug. 23, 1977

[30] Foreign Application Priority Data

Aug. 31, 1976 [JP] Japan ..... 51-104151

[51] Int. Cl.[2] ..... B41J 35/22

[52] U.S. Cl. ..... 400/214

[58] Field of Search ..... 197/126 B, 151, 153 R, 197/153 A, 156

[56] References Cited

U.S. PATENT DOCUMENTS

| | | | |
|---|---|---|---|
| 2,803,331 | 8/1957 | Berill | 197/153 R |
| 3,367,470 | 2/1968 | Berill | 197/153 R |
| 3,762,530 | 10/1973 | Patel | 197/151 |
| 3,927,747 | 12/1975 | Wolowitz | 197/151 |
| 3,980,171 | 9/1976 | Frechette | 197/151 |
| 3,995,731 | 12/1976 | Miller et al. | 197/151 X |

*Primary Examiner*—Ernest T. Wright, Jr,
*Attorney, Agent, or Firm*—Frank J. Jordan

[57] ABSTRACT

An inked ribbon changeover mechanism for a printing machine, in which a plurality of inked ribbons are looped over a plurality of guide members, respectively. The guide members are carried on a movable member, which is arranged to be movable to first and second positions relative to a printing head such that a selected one of the inked ribbons is placed in an operative position in which a portion of the selected one of the inked ribbons is located in a space between the printing head and a record medium when the printing head is in a printing position.

20 Claims, 9 Drawing Figures

Fig. 2B
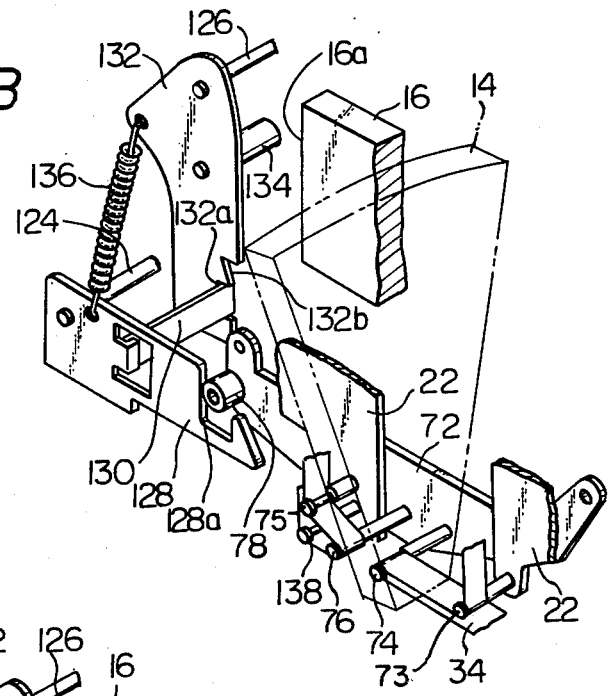
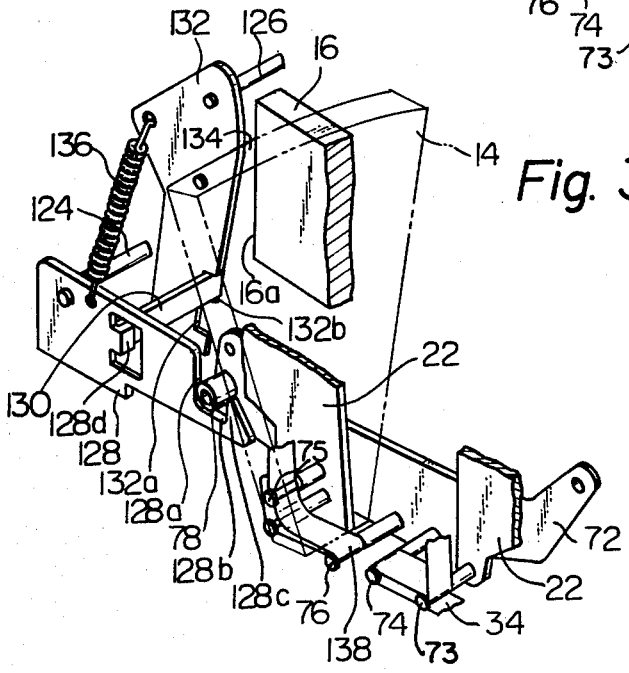
Fig. 3B

MULTIPLE INKED RIBBON COLOR CHANGEOVER MECHANISM FOR PRINTING MACHINE

This invention relates to a mechanism for changing the color of characters to be printed on a record medium, and more particularly, to an inked ribbon changeover mechanism for use in a printing machine.

Inked ribbons generally possess two or more ink colors and are of two basic types. In one, the ribbon is divided in the direction of its length and the colors are applied to the partitioned sections of the ribbon in regular succession. In the other, the colors are applied in such a manner that the ribbon is divided in the direction of its width.

Conventional mechanisms for effecting a printing color changeover relied almost entirely upon the inked ribbons of the aforementioned type. The inked ribbon divided and colored in the direction of its length possessed a number of disadvantages in that it required the installation of a color detection mechanism, the time during which the ribbon is passed through the printer is wasted when a certain color is unnecessary, the inked ribbons themselves were quite expensive, and the entire ribbon had to be discarded when, due to differences in the frequency of use, any one of the colors was depleted. Furthermore, in a case where a printing head and record medium are disposed quite close to one another as in a printing machine which makes use of the widely known wire dot matrix printing head, it is extremely difficult to move the ribbon in the direction of its width in the narrow gap between the printing head and the record medium when using the above-mentioned inked ribbon which is divided and colored in the direction of its width. In printing machines which process record media of varying thickness such as printing machines of the type which handle bank passbooks, a construction is generally adopted in which a member which receives the platen is disposed opposite the platen which is biased toward the printing head by means of a spring. This member is disposed so as to approach the print line over a range which will not interfere with the course of the printing head and so as not to degrade printing quality. As a result, a ribbon divided and colored in the direction of its width cannot be installed due to interference between it and said member.

It is, therefore, an object of the present invention to provide an inked ribbon changeover mechanism for a printing machine, which mechanism is arranged to shift a portion of a plurality of inked ribbons to the position of a printing head to allow a record medium to be printed thereon.

It is another object of the present invention to provide an inked ribbon changeover mechanism arranged to perform ribbon changeover through the utilization of a relative movement of a carrier or carriage of a printing machine.

It is another object of the present invention to provide an inked ribbon changeover mechanism including a movable means arranged to perform ribbon changeover upon engagement of the movable member with a stopper of the mechanism.

It is another object of the present invention to provide an inked ribbon changeover mechanism including a movable means arranged to perform ribbon changeover upon engagement of the movable member with a hooked portion of the mechanism during a returning stroke of a carrier or carriage of a printing machine.

It is still another object of the present invention to provide an inked ribbon changeover mechanism for a printing machine of the type having a carrier or carriage in which selection of a particular ribbon from a plurality of inked ribbons is performed in dependence on stroke positions of the carrier or carriage in the course of their relative movements.

It is a further object of the present invention to provide an inked ribbon changeover mechanism for a printing machine in which a selected one of a plurality of inked ribbons is placed in an operative position to allow a record medium to be printed thereon and ribbon feed is stopped when the inked ribbon is out of the operative position.

It is a still further object of the present invention to provide an inked ribbon changeover mechanism for a printing machine, the mechanism being arranged to perform rapid changeover without using complicated inked ribbons.

It is a still further object of the present invention to provide an inked ribbon changeover mechanism for a printing machine, which mechanism is simple in construction and highly reliable in operation.

These and other objects, features and advantages of the present invention will become more apparent from the following description when taken in conjunction with the accompanying drawing, in which:

FIG. 2B is a partial perspective view of the mechanism immediately before changeover to a red inked ribbon;

FIG. 3B is a partial perspective view immediately before changeover to a black inked ribbon;

Before entering into detailed description of the present invention, it should be noted that, while an inked ribbon changeover mechanism of the present invention will be described as applied to a printing machine of the wire dot matrix printing head type by way of example, the ribbon changeover mechanism of the present invention may be applied to any other type of printing machine.

Figure 1:
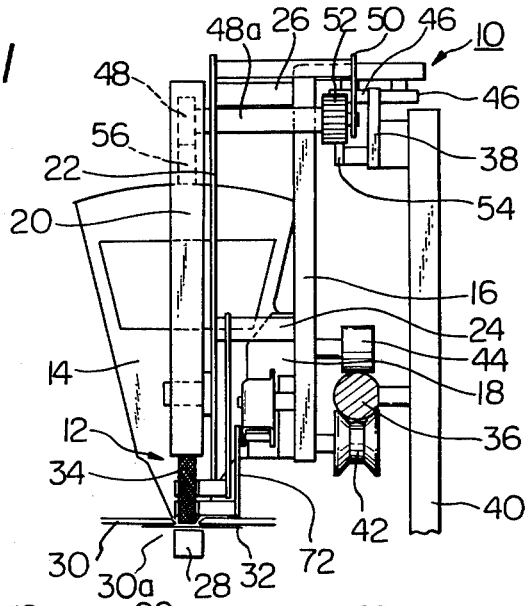
FIG. 1 is a side view of a printing machine incorporating an inked ribbon changeover mechanism according to the present invention.

In FIG. 1, there is schematically shown a portion of an example of a printing machine 10 incorporating an inked ribbon changeover mechanism 12 according to the present invention. The printing machine 10 is shown as having a wire dot matrix printing head 14 supported on a carrier 16 by way of a printing head mounting member 18. Reference numeral 20 designates a black ribbon cassette detachably attached to a ribbon base plate 22 which is secured to carrier 16 by means of supporting columns 24 and 26. Reference numeral 28 denotes a platen operatively coupled to drive means (not shown) so as to be brought into pressured contact with, or separated from, a platen holder 30, the platen 28 being so disposed as to permit a record medium 32 to be interposed and clamped between the platen 28 and platen holder 30. Platen holder 30 is provided with a window 30*a* having a minimum necessary width (perpendicular to the printing direction) for preventing the bulging of a record medium 32 such as a thick form or passbook and in order to allow characters to be printed adjacent to the fold of a passbook. Reference numeral 34 denotes a black inked endless ribbon the major portion of which is accommodated within the black ribbon cassette 20. Reference numerals 36, 38 designate carrier guide members for guiding carrier 16 during its operation, which carrier guide members 36, 38 are secured to frame 40 of the printing machine 10 parallel to a print line, and held by holding members 42, 44 and 46 rotatably supported by carrier 16. This arrangement allows the drive means to reciprocate the carrier 16 in a straight line in the direction of the print line. Reference numeral 48 denotes a rotatable feed roller axially supported by ribbon base plate 22 and a supporting plate 50 secured thereto. A gear wheel 52 accommodating a conventional one-way clutch (not shown) is fitted onto the shaft 48*a* of feed roller 48 and is in meshing engagement with a rack 54 secured in parallel to the carrier guide member 38, the feed roller 48 being adapted so as to rotate only when carrier 16 moves in the printing direction, i.e., in the direction of arrow A in FIGS. 2A and 3A. Reference numeral 56 denotes a rotatable pinch roller axially supported by black ribbon cassette 20 and brought into abutting contact with feed roller 48 through the intermediary of black endless ribbon 34.

Figure 4:
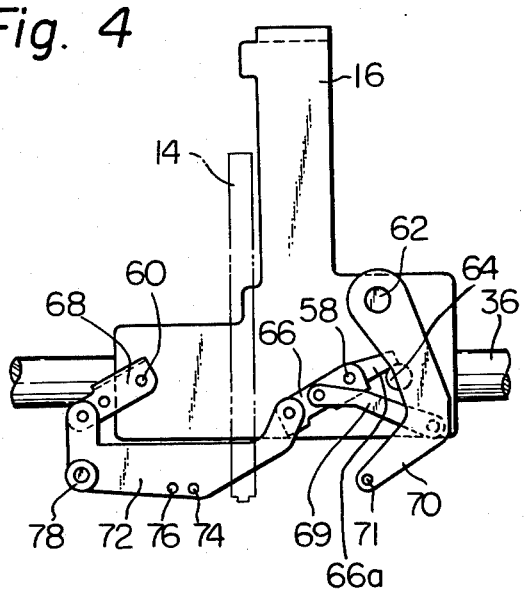
FIG. 4 is a plan view of a carrier forming part of the machine shown in FIG. 1.

In FIG. 4, carrier 16 has pins 58, 60, 62 and a stopper pin 64, pin 58 providing pivotal support for a right-hand rocking lever 66, pin 60 providing pivotal support for a left-hand rocking lever 68, and pin 62 providing pivotal support for a black ribbon slack compensating lever 70 having a slack compensating roller 71. The free ends of rocking levers 66 and 68 provide swingable support for either end of a movable member of plate 72 which carries a black ribbon guide member 74 and a red ribbon guide member 76 and which provides axial support for a rotatable roller 78. Stopper pin 64 is positioned so that it will come into abutting contact with right-hand rocking lever 66 which is capable of pivoting in the clockwise and counter-clockwise directions.

Figure 5A:
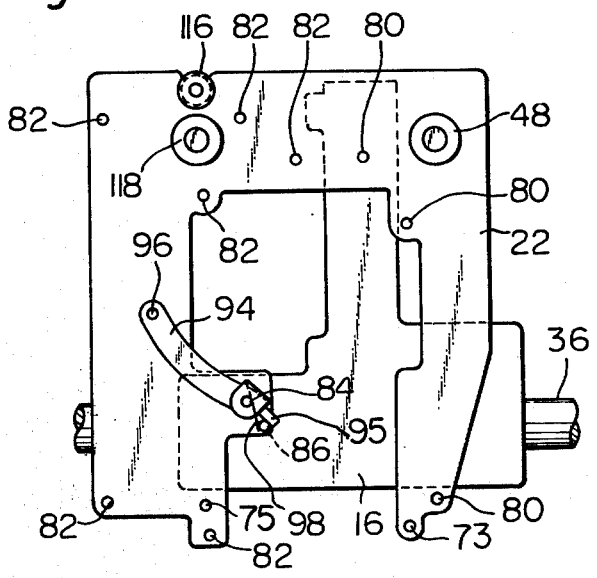
FIG. 5A is a front side view of a ribbon base plate.
Figure 5B:
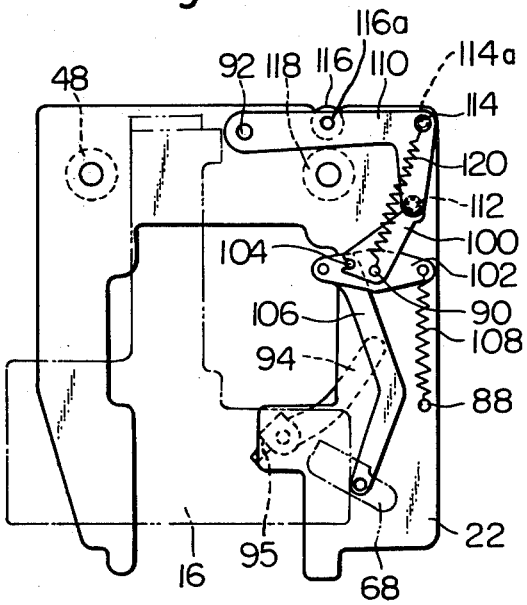
FIG. 5B is a back side view thereof.

With reference to FIGS. 5A and 5B which depict the front side and back side (defined as the side facing carrier 16) of ribbon base plate 22, provided on the front side (FIG. 5A) of the base plate 22 are a plurality of black ribbon guide rollers 80, red ribbon guide rollers 82, a pin 84 and a abutment shaft 86. The back side (FIG. 5B) of the base plate 22 is provided with pins 88, 90 and 92. The end of pin 84 provides pivotal support for a slack compensating lever 94 having a slack compensating roller 96. Pin 84 is provided with a spring 98 the ends of which engage, respectively, the shaft 86 and the red ribbon slack compensating lever 94 so as to apply the lever 94 with a rotative force acting in the clockwise direction in FIG. 3A. As the result of this rotative force, a projection 95 formed at the end of slack compensating lever 94 is brought into abutting contact with the shaft 86. Pin 90 provides pivotal support for a stop lever 100 one end of which is formed with a fork portion. A changeover arm supporting lever 102 is disposed between stop lever 100 and ribbon base plate 22 at the back side of the ribbon base plate 22. The forked end of stop lever 100 is engaged with a pin 104 which projects from a changeover arm 106 disposed between stop lever 100 and changeover arm supporting lever 102 at the back side of the ribbon base plate 22 as shown in FIG. 5B. Supporting lever 102 is biased pivotally in the counter-clockwise direction in FIG. 3A by means of a spring 108 one end of which is tied to the lever 102 while the other end is tied to pin 88. Pin 92 provides pivotal support for an L-shaped pinch roller supporting lever 110 which is provided with a pin 112 and an additional two pins 114*a* and 116*a* that provide axial support for a rotatable roller 114 as well as for rotatable pinch roller 116 which projects from the front side of ribbon base plate 22 and is in abutting contact with feed roller 118. A spring 120 stretched between pin 90 and the pin 114*a* that supports the roller 114 pivotally biases pinch roller supporting lever 110 in the counter-clockwise direction of FIG. 3A.

Figure 2A:
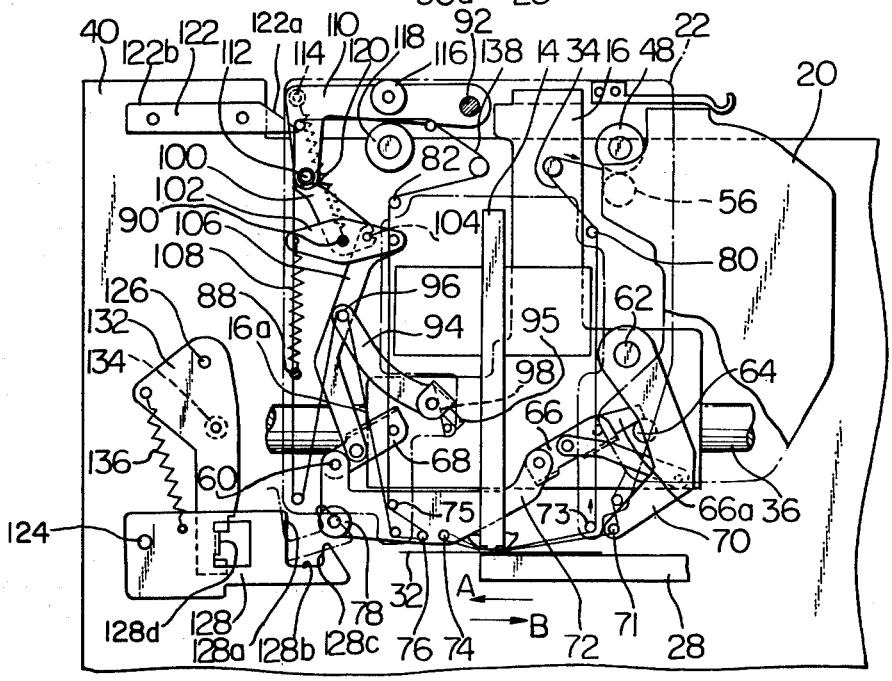
FIG. 2A is a plan view showing a black inked ribbon printing operation.
Figure 3A:
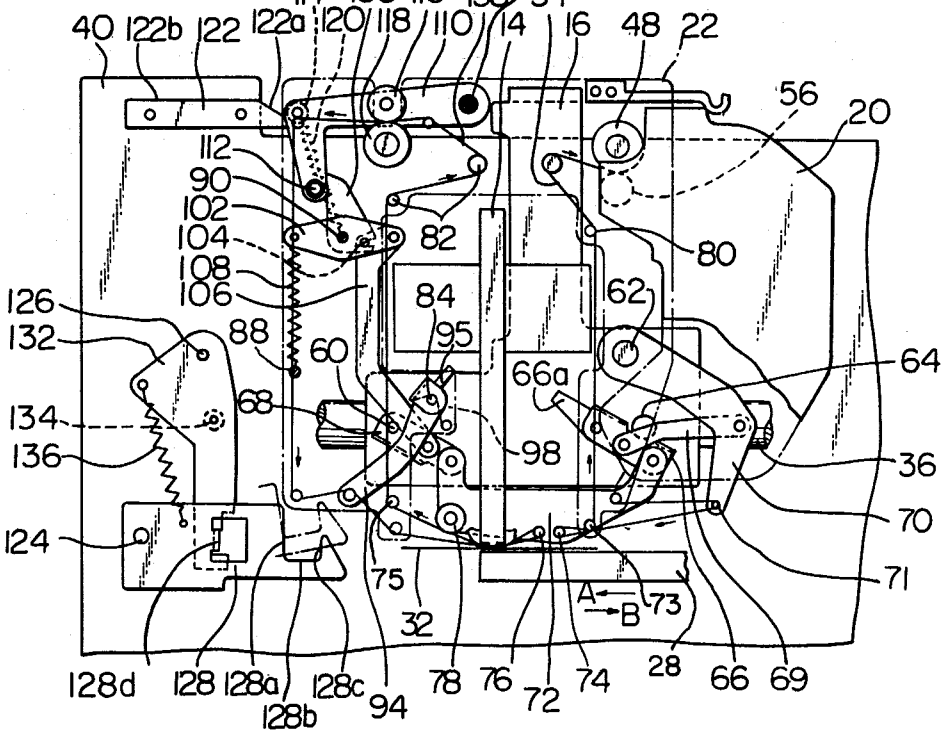
FIG. 3A is a plan view showing a red inked ribbon printing operation.

Referring to FIGS. 3A and 3B, a cam plate 122 is fixed to frame 40, which cam plate 122 includes an inclined portion 122*a* positioned so as to be engageable with roller 114, and a horizontal portion 122*b* with which roller 114 is capable of being in sliding contact. Pins 124, 126 are provided on frame 40. Pin 124 provides pivotal support for a changeover drive lever 128 the leading edge of which has a cut-out defined by the left side wall 128*a*, bottom wall 128*b* and right side wall 128*c*. An engagement member 130 is secured to changeover drive lever 128 at a portion 128*d* thereof which is bent toward the frame 40. Pin 126 provides pivotal support for a trigger lever 132 the end of which is formed with a recess 132*a* and a stepped portion 132*b*. A freely rotatable roller 134 (FIG. 2B) is mounted on the back side of trigger lever 132 in such a fashion as will bring the roller 134 into abutting contact with carrier 16. A spring 136 stretched between changeover drive lever 128 and trigger lever 132 tends to urge these levers 128 and 132 in the counter-clockwise direction in FIG. 3A. When engagement member 130 is in engagement with recess 132*a* of trigger lever 132, both levers 128, 132 are in their normal, stationary positions, as can be seen in FIGS. 2A and 2B. Reference numeral 138 denotes a red inked endless ribbon which, as can be seen in FIG. 2A, passes between feed roller 118 and pinch roller 116 and is guided by red ribbon guide roller 82, slack compensating roller 96, and red ribbon guide member 76. Black inked endless ribbon 34 is held between feed roller 48 and pinch roller 56 and guided by black ribbon guide roller 80, slack compensating roller 71 and black ribbon guide member 74. Both ribbons 34 and 138 are conveyed in a direction indicated by the arrows alongside these ribbons in FIG. 3A. In FIGS. 2A, 2B, 3A and 3B, stationary guide members 73 and 75 are supported by ribbon base plate 22 and engage with inked ribbons 34 and 138, respectively, at fixed positions relative to printing head 14. The movable member 72 serving as means for carrying movable guide members 74 and 76 is movable along a path parallel to the direction of lengths of the inked ribbons 34 and 138 to shift a selected one of the movable guide members 74 and 76 relative to a selected one of the stationary guide members 73,75 whereby the selected one of the movable guide members 74,76 maintains a looped portion of the selected one of the inked ribbons 34 and 138 in a predetermined orientation between the printing head 14 and the record medium 32.

For a description of the operation of the ribbon changeover mechanism constructed as described above, the black ribbon printing operation, the changeover operation from the black ribbon 34 to the red ribbon 138, the red ribbon operation and the changeover operation from the red ribbon 138 to the black ribbon 34 will now be described in that order.

With reference to FIG. 2A, the black ribbon printing operation is as follows. Black ribbon guide member 74 and red ribbon guide member 76 of movable member 72 are located to the left of printing head 14, and the black inked endless ribbon 34 is looped over the black ribbon guide member 74 so that the ribbon 34 overlaps itself in the gap between printing head 14 and record medium 32 which is to be printed thereon. Drive means (not shown) reciprocate carrier 16, and hence printing head 14, in a straight line between an initial printing or first extreme position located on platen 28 at the right edge thereof and a final printing or second extreme position located on the platen 28 at its left edge. When carrier 16 is moved in the printing direction (in the direction of arrow A), feed roller 48 is rotated in the counter-clockwise direction thereby to feed black inked endless ribbon 34 held between the feed roller 48 and pinch roller 56. Printing head 14 moving in cooperation with carrier 16 accommodates a plurality of wires (not shown) which, through the intermediary of the black inked ribbon 34, and in response to an external signal, impact the record medium 32 held between platen holder 30 and platen 28 thereby to print a desired character on the medium 32. When carrier 16 moves in the opposite direction (in the direction of arrow B), the fact that feed roller 48 is coupled to the one-way clutch prevents the rotation of the feed roller 48 and hence reverse feeding of black inked ribbon 34 even when gear wheel 52 engaging with rack 54 rotates in the clockwise direction. Further, although feed roller 118 rotates in entirely the same manner as feed roller 48, pinch roller 116 is separated from feed roller 118 during movement of the carrier 16 in the printing direction so that there is no unnecessary conveyance of the red inked ribbon 138 during the black ribbon printing operation.

The changeover operation from the black inked ribbon 34 to the red inked ribbon 138 will now be described with reference to FIG. 2A and FIG. 2B. For printing a row of red characters following a row of black characters, carrier 16 in response to an external signal is moved in the direction of arrow A beyond the second extreme position so that roller 78 mounted on movable member 72 strikes the left side wall 128*a* of changeover drive lever 128. When carrier 16 is moved still further in the direction of arrow A, changeover drive lever 128 functions as a stopper so that movable member 72 begins to pivot toward the right. Mid-way through the pivoting of the movable member 72, the resiliency of spring 108, acting through left-hand rocking lever 68, changeover arm 106, and the changeover arm supporting lever 102, reverses the position of the movable member 72 which comes to rest when the main body of right-hand rocking lever 66 strikes stopper shaft 64. Since movable member 72 has been moved to the right, the red inked ribbon 138 contacting and guided by guide member 76 is shifted into position below the end of printing head 14 where the ribbon 138 overlaps itself. The black inked ribbon 34 is shifted to a position removed from the vicinity of the printing head 14. Thus, at the time of the black-to-red changeover, the movement of carrier 16 in the leftward direction ceases directly before the carrier 16 strikes roller 134 mounted on trigger lever 132. Following the changeover, the carrier 16 begins to move in the direction of arrow B to return the printing head 14 to its first extreme position and thereafter, during the red inked ribbon printing operation, reciprocates between the first and second extreme positions.

In a manner as will now be described, red inked ribbon 138 is fed out at the same time that the above-mentioned changeover is effected. By causing carrier 16 to move in the direction of arrow A beyond the second extreme position, roller 114 mounted on pinch roller supporting lever 110 comes into abutting contact with the horizontal portion 122*b* of cam plate 122 by first sliding along the inclined portion 122*a*. The supporting lever 110 is thus pivoted in the clockwise direction against spring 120 so that pin 112 protruding from the free end of the lever 110 is disengaged from stop lever 100. By virtue of the previously described rightward movement of movable member 72 which takes place immediately after the disengagement of the pin 112 from the stop lever 100, the lever 100 is caused to pivot in the clockwise direction and thus shift to a position removed from the vicinity of its former point of contact with the pin 112, this being accomplished due to the engagement between the lever 100 and pin 104 projecting from changeover arm 106, which is coupled to movable member 72 by way of left-hand rocking lever 68. The subsequent movement of carrier 16 in the direction of arrow B ends the state of contact between cam plate 122 and roller 114, whereby pinch roller supporting lever 110, now no longer restrained by stop lever 100, is acted upon by the resiliency of spring 120 and thus caused to rotate in the counter-clockwise direction. Accordingly, as can be seen in FIG. 3A, pinch roller 116 which is mounted on pinch roller supporting shaft 116*a* is brought into pressured contact with feed roller 118 thereby clamping red inked ribbon 138 therebetween in order to enable its conveyance. Owing to the tension which develops in ribbon 138 following its shift into the operative position, red inked ribbon slack compensating lever 94 pivots in the counter-clockwise direction. However, since spring 98 biases the lever 94 in the clockwise direction, the red inked ribbon 138 is not permitted to slacken. Meanwhile, right-hand rocking lever 66, due to the rightward movement of movable member 72, is pivoted in the counter-clockwise direction so that black ribbon slack compensating lever 70 is also pivoted in the counter-clockwise direction by means of link 69 which is coupled to right-hand rocking lever 66. This permits the slack compensating lever 70 to remove any slack that develops in black inked ribbon 34 at the time that the movable member 72 is shifted. Since the red ink printing operation in the printing machine of the present embodiment is performed far less often than the black printing operation, the black inked ribbon 34 continues to be conveyed from its cassette 20 even during the red ink printing operation.

Following the changeover to the red inked ribbon 138, the red ink printing operation proceeds in a manner identical to that of the previously described black ink printing operation.

The changeover operation from the red inked ribbon 138 to the black inked ribbon 34 will now be described with reference to FIGS. 3A and 3B. For printing a row of black characters following a row of red characters, carrier 16 in response to an external signal is moved in the direction of arrow A beyond the final printing column or second extreme position and beyond the point at which the red inked ribbon changeover was accomplished so that the left side portion 16*a* of carrier 16 strikes roller 134 mounted on trigger lever 132 which is hus caused to pivot in the clockwise direction. As a esult, engagement member 130 fixed to changeover drive lever 128 is shifted from recess 132*a* to a position where it engages with stepped portion 132*b*. Immediately before engagement member 130 is shifted into the engaging relation with stepped portion 132*b*, roller 78 mounted on movable member 72 is located above the cutout formed in changeover drive lever 128 and then is brought into abutting contact with the bottom wall 128*b* of the cutout when the changeover drive lever 128 is pivoted in the counter-clockwise direction by spring 136 which is allowed to act due to the shifting and reengagement of the engagement member 130. In this condition, carrier 16 begins to return in the direction of arrow B toward the initial printing column position, whereupon roller 78 strikes the right side wall 128*c* of changeover drive lever 128 so that movable member 72 begins to pivot in the clockwise direction. At this time the distance between roller 78 and pin 60, which is the center of the pivotal motion, gradually begins to lengthen and reaches a maximum directly below pin 60. Since roller 78 is in abutting contact with bottom wall 128*b* at the position where this distance is maximized, changeover drive lever 128 is pivoted in the clockwise direction and then is returned to its original position by virtue of the fact that engagement member 130 is brought into engagement with recess 132*a* of trigger lever 132. Movable member 72 is thus reversed by spring 108 and comes to rest when the projection 66*a* of right-hand rocking lever 66 strikes stopper shaft 64. At this point roller 78 is disengaged from the right side wall 128*c* of changeover drive lever 128, and carrier 16 is subsequently moved in the direction of arrow B in order to return printing head 14 to the initial column printing position.

In a manner as will now be described, the feeding of red inked ribbon 138 is halted at the same time that the above-mentioned changeover operation is effected. Roller 114 mounted on pinch roller supporting lever 110 is brought into contact with the horizontal portion 122*b* of cam plate 122, thereby causing the lever 110 to pivot in the clockwise direction so that pinch roller 116 separates from feed roller 118. Movable member 72 by shifting toward the left, causes stop lever 100 to pivot in the counter-clockwise direction and slip in below pin 112 protruding from pinch roller supporting lever 110. The pin 112 comes into abutting contact with the stop lever 100 after the movement of carrier 16 in the direction of arrow B causes cam plate 122 to separate from roller 114. Since pinch roller 116 is no longer in contact with feed roller 118, the red inked ribbon 138 is not fed out during the black ink printing operation. Further, spring 98 urges red ribbon slack compensating lever 94 in the clockwise direction so as to prevent the slackening of ribbon 138 which tends to loop due to the leftward movement of movable member 72 when the member 72 is reversed. Meanwhile, since black ribbon slack compensating lever 70 operates in concert with movable member 72 during its leftward reversal, it is possible to prevent the black inked ribbon 34 from being sharply pulled out of its cassette 20.

This completes the descriptive account of the operation. It should be noted, however, that both of the ribbons 34 and 138 overlap themselves to introduce a double ribbon layer between the printing head 14 and the record medium 32. In cases where characters are produced from a plurality of spots or dots as are printed by the wires of a matrix printer, the overlapping ribbon arrangement is superior to an arrangement which makes use of a single ribbon strip since the spots or dots produced possess a diameter which is greater than that of the wire thereby making it possible to form more distinct characters.

Figure 6:
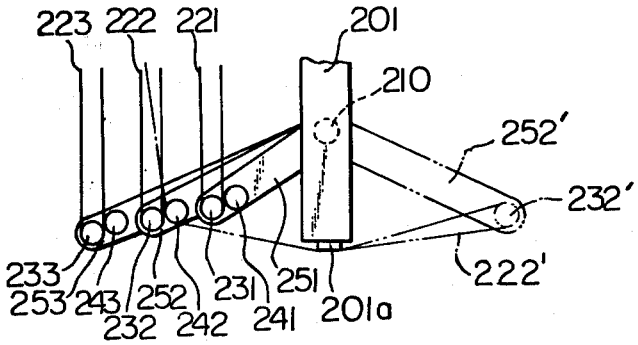
FIG. 6 is a partial plan view of a modified form of the inked ribbon changeover mechanism shown in FIG. 1.

Although the present embodiment depicts a changeover between two inked ribbons 34 and 138, it is also possible to effect a changeover among three or more ribbons by adopting the construction illustrated in FIG. 6. Here, pivotal movable members 251, 252, 253 are mounted on a pin 210 which projects from printing head 201. The free end of each movable member 251, 252, 253 supports a respective guide member 231, 232, 233 each of which guides a respective inked ribbon 221, 222, 223. Reference numerals 241, 242, 243 denote stationary guide members to stretch the respective inked ribbons 221, 222, 223 when the respective guide members 231, 232, 233 are shifted to an operative position shown in FIG. 6. Since guide members 231, 232, 233 are capable of being shifted to another stable position by the movable members 251, 252, 253, such as guide member 232' mounted on the movable member 252' which guide member 232' is shown after having been shifted, each of the corresponding ribbons 221, 222, 223 can be stretched between the corresponding stationary guide roller and the guide member and brought into a position opposite the end 201*a* of printing head 201 as shown by ribbon 222'.

In the present embodiment, the printing machine 10 makes use of a system that reciprocates the printing head 14. However, the construction of the present invention can equally well be applied to printing machines in which the record medium 32 is moved.

The present invention thus makes it possible to achieve rapid and reliable ribbon changeover without using complicated inked ribbons even in cases where design limitations are imposed by the printing head and record media supporting mechanism as in printing machines which employ a wire dot matrix printing head. Changeover can be accomplished without any degradation in printing quality, especially in printing machines which process record media of varying thickness such as printing machines of the type which handle bank passbooks. Finally, special-purpose type ribbons which possess a number of colors are uneconomical since the entire ribbon must be discarded when, due to differences in the frequency of use, any one of the colors is depleted. This is another shortcoming which the present invention overcomes.

It will now be appreciated from the foregoing description that in accordance with the present invention, since ribbon changeover can be performed by utilizing relative movement of a carrier or carriage of a printing machine, a changeover mechanism can be constituted by a minimum number of component parts. This is reflected by a simplified construction, highly improved operating reliability and low manufacturing cost. It should also be born in mind that since control of changeover of a plurality of inked ribbons is performed in accordance with a stroke position of the carrier or carriage in the course of their relative movements, it is possible to perform changeover from one inked ribbon to a desired inked ribbon by controlling the mode of relative movement i.e., the strokes of the carrier or carriage with the use of the same control means as that of the carrier or carriage. Thus, no specific control device for the control of ribbon changeover is required and, therefore, no signal feed line to the specific control device is required. Accordingly, the number of electrical connections between a controller and associated devices can be minimized. For all of these various reasons, the changeover mechanism of the present invention can be simplified in construction, highly reliable in operation, and manufactured in low cost. Another advantage attained by the present invention is that since the feeding of a given inked ribbon is halted when it is in an inoperative position, excessive wear and undesirable deterioration of the ribbon can be minimized and load on a driving means to effect relative movement of the carrier or carriage can be reduced.

While the present invention has been shown and described with reference to particular embodiments in which black and red ribbons are used, it should be noted that the same black ribbons may be used as a spare with respect to one another.

What is claimed is:

1. In an inked ribbon changeover mechanism for a printing machine having a printing head for impacting a record medium to print a character thereon by means of a looped portion of a selected one of a plurality of inked ribbons, a frame, and a carrier supporting said printing head and guided by carrier guides secured to said frame, the improvement comprising:

a plurality of stationary guide members engaging with said plurality of inked ribbons, respectively, at fixed positions relative to said printing head;

a plurality of movable guide members engaging with said plurality of inked ribbons, respectively, to guide said plurality of inked ribbons in a direction of their lengths;

means for carrying said plurality of movable guide members, said carrying means being movable along a path parallel to the direction of said lengths to shift a selected one of said movable guide members to an operative position relative to a selected one of said stationary guide members whereby said selected one of said movable guide members maintains said looped portion of said selected one of said plurality of inked ribbons in a predetermined orientation between said printing head and said record medium.

2. The improvement according to claim 1, in which said movable guide members comprise first and second ribbon guides secured to said carrying means in spaced relationship with respect to each other.

3. The improvement according to claim 1, in which said carrying means comprises a swingable movable member supported by said carrier and swingably movable to said operative position.

4. The improvement according to claim 3, in which said carrying means further comprises first and second rocking levers operatively connected between said movable member and said carrier to enable swingable movement of said movable member relative to said printing head.

5. The improvement according to claim 3, in which said carrier is movable along said path to predetermined changeover positions to shift the position of said movable member relative to said printing head.

6. The improvement according to claim 5, further comprising changeover means for shifting the position of said movable member when said carrier is moved to said predetermined changeover positions.

7. The improvement according to claim 6, in which said changeover means comprises a changeover drive lever movable to first and second angular positions and mounted on said frame, said changeover drive lever including first and second engaging portions, a trigger lever mounted on said frame to retain said changeover drive lever in its first and second angular positions when said carrier is moved to said predetermined changeover positions, respectively, and an engaging element mounted on said movable member and engageable with said first and second engaging portions of said changeover drive lever when said changeover drive lever is held at said first and second angular positions, respectively, to shift said movable member to said operative position.

8. The improvement according to claim 7, in which said trigger lever has first and second engaging portions, and in which said changeover drive lever has an engagement member engaging with said first engaging portion of said trigger lever when said carrier is moved to one of said predetermined changeover positions, said trigger lever being rotatable to a direction in which said engagement member of said changeover drive lever engages with said second engaging portion of said trigger level when said carrier is moved to another one of said predetermined changeover positions.

9. The improvement according to claim 1, in which said plurality of inked ribbons include an inked ribbon accommodated in a cassette detachably mounted on said carrier.

10. The improvement according to claim 1, further comprising a ribbon base plate secured to said carrier, a feed roller rotatably supported by said ribbon base plate and engaging with another one of said plurality of inked ribbons, a pinch roller carried by a pinch roller support lever supported by said ribbon base plate and engageable with said feed roller to enable feeding of said another one of said plurality of inked ribbons in said direction, and means for stopping the feeding of said another one of said plurality of inked ribbons when said another one of said plurality of inked ribbons is out of said operative position.

11. The improvement according to claim 10, in which said stopping means comprises means for holding said pinch roller support lever to disengage said pinch roller from said feed roller when said another one of said plurality of inked ribbons is out of said operative position, and means for releasing said holding means from said pinch roller support lever for thereby engaging said pinch roller with said feed roller when said another one of said plurality of said inked ribbons is in said operative position.

12. The improvement according to claim 1, in which said plurality of inked ribbons are looped over said guide members, respectively.

13. The improvement according to claim 1, in which said carrying means comprise a plurality of movable members carrying said plurality of said guide members, respectively.

14. In an inked ribbon changeover mechanism for a printing machine having a printing head for impacting a record medium to print a character thereon by means of one of a plurality of inked ribbons, a frame, and a carrier supporting said printing head and guided by carrier guides secured to said frame, the improvement comprising:

a plurality of guide members engaging with said plurality of inked ribbons, respectively, to guide said plurality of inked ribbons in a direction of their lengths;

a movable member swingably supported by said carrier and carrying said plurality of guide members, said movable member being movable to an operative position along a path parallel to said direction to locate one of said guide members in a predetermined position relative to said printing head to cause a portion of one of said plurality of inked ribbons to move to a position in which said portion of one of said plurality of inked ribbons is held in a space between said printing head and said record medium when said printing head is in a printing position; and change-over means mounted on said frame of said printing machine for effecting swingable movement of said movable member to enable shift of said movable member to said operative position when said movable member is moved to a given change-over position, said change-over means comprising a changeover drive lever mounted on said frame and movable to a given angular position for actuating said movable member to effect said swingable movement when said carrier is moved to a given changeover position, and a trigger lever for retaining said changeover drive lever in said given angular position.

15. In an inked ribbon change-over mechanism for a printing machine having a frame, a carrier guided by carrier guides connected to the frame, and a printing head supported by said carrier for impacting a record medium to print a character thereon by means of one of a plurality of inked ribbons, the improvement comprising:

a plurality of guide members engaging with said plurality of inked ribbons;

a movable member swingably supported by said carrier and carrying said plurality of guide members thereon in a spaced relationship with respect to each other, said movable member having an engaging element and normally assuming a first operative position in which one of said guide members locates a portion of one of said inked ribbons engaging said one of said guide members in a space between said printing head and said record medium during a printing operation; and a change-over drive lever pivotally mounted on said frame and including a first engaging portion against which said engaging element abuts when said carrier is moved to a first change-over position whereby said movable member is shiftable to a second operative position in which another one of said guide members locates a portion of another one of said inked ribbons engaging said another one of said guide members in said space, and a second engaging portion against which said engaging element is engageable when said carrier is moved to a second change-over position whereby said movable member is shifted to said first operative position.

16. The improvement according to claim 15, further comprising a trigger level pivotally mounted on said frame and normally holding said change-over drive lever at a first angular position whereby when said carrier is moved to said first position, said engaging element of said movable member is caused to abut against said first engaging portion of said change-over lever, said engaging element rotating said change-over drive lever to its second angular position when said carrier is moved to said second change-over position whereby said engaging element of said movable member is caused to engage with said second engaging portion of said change-over drive lever when said carrier is moved from said second change-over position back to its original position.

17. The improvement according to claim 16, further comprising urging means for urging said change-over lever and said trigger lever.

18. In an inked ribbon changeover mechanism for a printing machine having a frame, a carrier guided by carrier guides connected to the frame, and a printing head for impacting a record medium to print a character therein by means of one of first and second linked ribbons, the improvement comprising:

first and second guide members engaging with said first and second inked ribbons, respectively, to guide said first and second inked ribbons in a direction of their lengths;

a movable member carrying said first and second guide members, said movable member normally assuming a first position in which said first guide member locates said first inked ribbon in an operative position, and said movable member being shiftable to a second position in which said second guide member locates said second inked ribbon in an operative position;

a plurality of guide rollers mounted on a ribbon base plate supported by said carrier and engaging with said second inked ribbon;

a feed roller mounted on said ribbon base plate between two of said guide rollers;

a pinch roller supported by a pinch roller supporting lever pivotally mounted on said ribbon base plate; and means for holding said pinch roller supporting lever at a position in which said pinch roller is in disengagement with said feed roller when said second inked ribbon is held in its in inoperative position, said holding means being operative to rotate said pinch roller supporting lever in a direction to cause said pinch roller to engage with said feed roller thereby to enable feeding of said second inked ribbon while in its operative position.

19. In an inked ribbon changeover mechanism for a printing maching having a printing head for impacting a record medium to print a character thereon by means of a plurality of inked ribbons, a frame, and a carrier supporting said printing head and guided by carrier guides secured to said frame, the improvement comprising:

a plurality of guide members engaging with said plurality of inked ribbons, respectively, such that each of said inked ribbons is looped over each of said guide members whereby said each of said inked ribbons overlaps itself in a gap between said printing head and said record medium;

a movable member swingably supported by said carrier and carrying said plurality of guide members, said movable member normally assuming a first position in which a portion of one of said inked ribbons is located in an operative position in an overlapped state by one of said guide members, and said movable member being operative to assume another position in which another one of said guide members locates a portion of another one of said inked ribbons in said operative position in the overlapped state; and means for effecting swingable movement of said movable member to enable shifting the position of said movable member relative to said printing head, said effecting means comprising a changeover driver lever mounted on said frame and having an engaging portion with which said movable member engages and is moved to said another position to changeover said plurality of inked ribbons when said carrier is moved to a given changeover position.

20. In an inked ribbon changeover mechanism for a printing machine having a printing head for impacting a record medium to print a character thereon by means of a looped portion of a selected one of a plurality of inked ribbons, the improvement comprising:

a plurality of stationary guide members engaging with said plurality of inked ribbons, respectively, at fixed positions relative to said printing head;

a plurality of movable guide members engaging with said plurality of inked ribbons, respectively, to guide said plurality of inked ribbons in a direction of their lengths; and a plurality of movable members carrying said plurality of movable guide members, respectively, each of said movable members normally assuming a first position in which a portion of each of said plurality of said inked ribbons is held in an inoperative position by each of said movable guide members, and a selected one of said movable members being pivotally movable to a second position to shift the position of a selected one of said plurality of movable guide members relative to a selected one of said plurality of stationary guide members for thereby bringing said looped portion of said selected one of said plurality of inked ribbons to a predetermined orientalion in a gap between said printing head and said record medium.

* * * * *